US006726006B1

(12) United States Patent
Funderburk et al.

(10) Patent No.: US 6,726,006 B1
(45) Date of Patent: Apr. 27, 2004

(54) FLASK-SHAPED CIGARETTE CONTAINER AND METHOD OF PACKAGING CIGARETTES

(76) Inventors: Douglas Amon Funderburk, 1017 Englewood Dr., Winston-Salem, NC (US) 27106; Charles Ray Ashcraft, 5168 Huntcliff Trail, Winston-Salem, NC (US) 27104; Walter Bohdan, 1909 Boyer Rd., Powhatan, VA (US) 23139; Ellen Strickland Gossett, 252 Charles Dr., Winston-Salem, NC (US) 27107; Nancy Harmon Hawley, 2509 Innisfail La., Clemmons, NC (US) 27012; Jane Cottrell Henson, 7024 Tramore La., Clemmons, NC (US) 27012; William Edward Hazlett, 14511 Benefice Ridge, Chesterfield, VA (US) 23838; Daniel Klaus Self, 22 Sweetland Ct., Greenville, SC (US) 29607

( * ) Notice: Subject to any disclaimer, the term of this patent is extended or adjusted under 35 U.S.C. 154(b) by 88 days.

(21) Appl. No.: 09/891,936

(22) Filed: Jun. 26, 2001

(51) Int. Cl.[7] ..... B65D 85/10; B65B 7/28

(52) U.S. Cl. ..... 206/268; 206/256; 206/264; 206/459.5; 53/471

(58) Field of Search ..... 206/768, 245, 206/256, 261, 269, 259, 264, 266, 484, 443, 459.5; 53/235, 236, 242, 234, 471, 489; 220/270, 834, 839, 675; 229/87.05, 87.13, 87.14, 87.18, 160.1; 283/56

(56) References Cited

U.S. PATENT DOCUMENTS 927,638 A 7/1909 Chambers
941,140 A 11/1909 Glover
970,258 A 9/1910 Nock
1,152,429 A * 9/1915 Marcuse ..... 206/265
1,496,474 A 6/1924 Lloyd
1,504,128 A 8/1924 Lindbom
1,522,633 A * 1/1925 Kister ..... 206/269
1,560,644 A 10/1925 Beaupre (List continued on next page.)

OTHER PUBLICATIONS

Douglas Congdon—Martin, "A Collector's Guide," *Tobacco Tins*, 1992, pp. 147, 66.

International Search Report from corresponding international application, PCT/US 02/17192, dated Oct. 9, 2002.

*Primary Examiner*—Mickey Yu
*Assistant Examiner*—Gregory Pickett
(74) *Attorney, Agent, or Firm*—Brinks Hofer Gilson & Lione

(57) ABSTRACT

A flask-shaped package or container for packaging smoking articles, such as cigarettes, has a generally parallelepiped shape with slightly curved front and back body panels. The container comprises a body and a lid integrally molded in one-piece of a plastic material with an open bottom having an internal peripheral shoulder and a base made of a separate plastic/metal foil laminate that is bonded to the shoulder by induction heating a heat-activated adhesive covering the metal foil of the base. The body has a central internal front-to-back stiffening rib and an access opening in its top and front panels with a surrounding ledge to which is adhesively bonded a removable foil closure. After the access opening is closed with the foil closure, cigarettes are inserted into the container body through the open bottom thereof. A protective paperboard liner that prevents adherence between the heat-activated adhesive and the cigarettes is inserted into the open bottom and supported by the central rib and the cigarettes. The base laminate is then inserted into the open bottom and bears on the shoulder so that when the adhesive is activated by induction heating, the base bonds to the shoulder and seals the container. An adhesive-backed label wrap with brand specific indicia is applied to the outer surfaces of the container.

48 Claims, 4 Drawing Sheets

U.S. PATENT DOCUMENTS

| | | | | | |
|---|---|---|---|---|---|
| 1,581,547 | A | | 4/1926 | Rowe | |
| 1,636,732 | A | | 7/1927 | Cabangis | |
| 1,685,765 | A | | 9/1928 | Mangan | |
| 1,830,583 | A | | 11/1931 | Ritz Woller | |
| 1,991,719 | A | | 2/1935 | Aronson | |
| 2,147,849 | A | | 2/1939 | Leo | |
| 2,148,319 | A | | 2/1939 | Negbaur | |
| 2,378,774 | A | | 6/1945 | Husted | |
| 2,867,369 | A | | 1/1959 | Cernera | |
| 2,960,264 | A | * | 11/1960 | Walter | 206/268 |
| 3,039,671 | A | * | 6/1962 | Chiamardas | 206/268 |
| 3,167,104 | A | * | 1/1965 | Wiley et al. | 206/268 |
| 3,223,275 | A | * | 12/1965 | Rice, Jr. | 206/268 |
| 3,327,887 | A | * | 6/1967 | Chalmers | 206/268 |
| 3,391,780 | A | * | 7/1968 | Pasquine et al. | 206/268 |
| 3,533,550 | A | * | 10/1970 | Benzon-Petersen | 206/264 |
| 4,000,812 | A | * | 1/1977 | Pisarski et al. | 206/268 |
| 4,090,660 | A | * | 5/1978 | Schram et al. | 220/270 |
| 4,476,665 | A | * | 10/1984 | Oberdorf | 53/236 |
| 4,678,080 | A | * | 7/1987 | Nelson | 206/387.1 |
| 4,923,059 | A | * | 5/1990 | Evers et al. | 206/265 |
| 5,044,550 | A | | 9/1991 | Lamm | |
| 5,081,820 | A | * | 1/1992 | Nedstedt | 53/242 |
| 5,097,948 | A | | 3/1992 | Campbell | |
| 5,405,007 | A | * | 4/1995 | Iwahashi | 206/268 |
| D370,081 | S | | 5/1996 | Mauldin | |
| 5,526,559 | A | | 6/1996 | Fleenor et al. | |
| 5,630,508 | A | * | 5/1997 | Petit | 206/268 |
| 5,938,018 | A | | 8/1999 | Keaveney et al. | |
| 5,983,600 | A | * | 11/1999 | Heide et al. | 53/415 |
| 6,164,444 | A | | 12/2000 | Bray et al. | |
| 6,168,014 | B1 | * | 1/2001 | Manservigi et al. | 206/268 |
| 6,435,342 | B1 | | 8/2002 | Agnes | |

* cited by examiner

FIG. 11
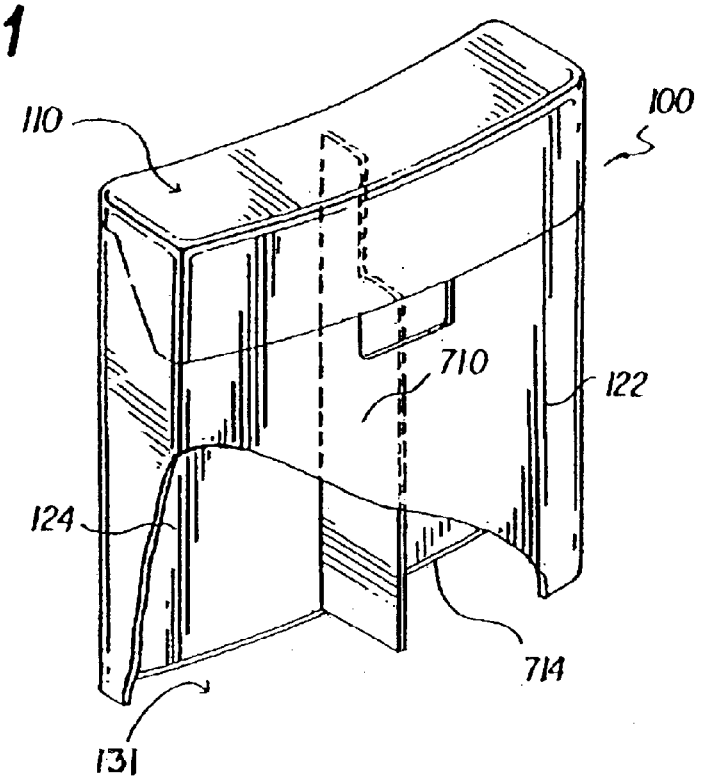
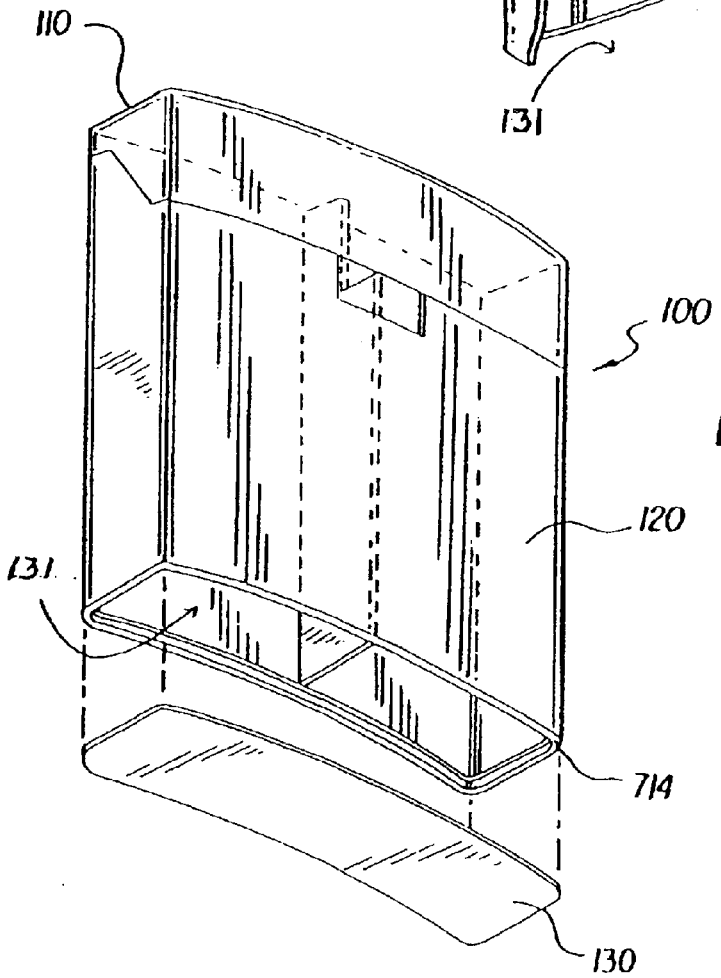
FIG. 12

FLASK-SHAPED CIGARETTE CONTAINER AND METHOD OF PACKAGING CIGARETTES

FIELD OF THE INVENTION

The present invention relates to packages and containers for cigarettes and a method for packaging cigarettes, the container having a flask-shaped design and being made of a durable plastic material to preserve the freshness of the cigarette contents of the container and to protect the cigarettes from being crushed.

BACKGROUND OF THE INVENTION

Cigarette packages and containers that protect the cigarettes from crushing and/or preserve the freshness of the cigarettes are known in the prior art. Typically, such prior art packages are box-shaped containers made of a paper or cardstock material in either a "softpack" or "hardpack" form. While some designs of the softpack package are capable of retaining a measure of freshness, the softpack package offers little or no protection against crushing. Similarly, some designs of the hardpack package help to preserve freshness to some extent and offer some protection against crushing, however, the cardstock materials that are typically used are vulnerable to damage and crushing under moderate loads. An example of a hardpack package is shown in U.S. Pat. No. 6,164,444 to Bray et al., which discloses a typical hinged-lid, box-shaped container that is made from a "rigid card material." Further examples of cigarette or tobacco packages made of a paper or cardstock material are disclosed in U.S. Pat. Nos. 1,496,474; 2,960,264; 5,044,550; and 5,097,948.

Other materials, such as metals, woods and plastic, have also been suggested for making crushproof and freshness-preserving cigarette containers, but have never attained widespread acceptance because of their typically high manufacturing costs. However, with the advancement of plastic manufacturing technology, it has become more cost effective for cigarette manufacturers to use plastic materials for cigarette containers. U.S. Pat. Nos. 2,867,369 to Cernera and 3,223,275 to Rice, Jr. disclose cigarette containers that may be made out of various materials, such as plastic, wood, metal and cardboard. However, neither Rice, Jr. nor Cernera take advantage of the inherent design and manufacturing versatility of plastic material because they contemplate cigarette container designs that are suitable for construction from wood, metal and paper, as well as plastic.

Paper or cardstock materials alone are not well-suited to preserving the freshness of the contents of a cigarette container because those materials generally do not provide a sufficiently air-tight or air-impermeable barrier. Typically, softpack and hardpack cigarette packages employ inner or outer wraps of metal foil/paper laminates, metallized paper or plastic wrappers, or low permeability transparent polymeric sheet overwraps to protect the freshness and aroma of packaged cigarettes and other smoking article products. However, the use of a plastic container molded from a polymeric material having a relatively high permeability would eliminate the need to use such wrappers and overwraps or, alternatively, in conjunction with such wrappers and overwraps, the air impermeability of molded plastic containers would be further enhanced.

It would therefore be desirable to provide a cigarette container made of a plastic material that protects the contents from accidental crushing and takes advantage of the other benefits of using a plastic material in a cigarette package.

SUMMARY OF THE INVENTION

The present invention is directed to a novel "crush-proof" plastic cigarette container that has a relatively thin, contoured shape with rounded corners that is easy for the consumer to handle and carry. Although the cigarette container of the invention may be configured in a number of forms that are not specifically illustrated herein, a preferred embodiment of the invention comprises a six-sided box with rounded corners, the front and back body panels of which are slightly curved to form a flask-shaped container that conforms generally to the contours of the human body.

The curved, flask-shape of the container also helps to distinguish the cigarette product from the cigarette products of other manufacturers, thereby increasing product identification with consumers. In addition to brand names and trademarks, the unique packaging of the present invention will help consumers identify the product origin and/or manufacturer. The curved body panels and rounded corners also increase the strength and rigidity of the container because they resist bending and flexing better than a container having flat body panels, particularly under the vacuum packing conditions of the container of the present invention.

The container is preferably configured with a relatively narrow front-to-back profile so that twenty cigarettes can be arranged in a 10-10 configuration, that is, two rows of ten cigarettes each. This gives the container a slimmer profile than the conventional box-shaped container which holds twenty cigarettes in a 7-6-7 configuration, i.e., three rows of seven, six, and seven cigarettes. The slight curve and narrow profile of the flask-shaped container accommodates the natural curves of the human hand and body so that it is easy to grasp in the hand and fits comfortably inside a shirt, coat or pant pocket. Although a container designed for the 10-10 cigarette configuration is preferred, other cigarette configurations are also possible, such as, for example, the conventional 7-6-7 configuration or other configurations with more or less than twenty cigarettes.

The container is preferably made of three components, namely, a lid and a body, which are preferably molded together in one piece of a plastic material, such as polypropylene, and a flat base that is preferably die-cut from a flat sheet of a plastic/metal, e.g., a polypropylene/aluminum foil laminate or injection molded of a plastic material, e.g., polypropylene, with a metal foil substrate, such as aluminum foil, bonded to one surface thereof. The body is molded with an open bottom and four panels, i.e., a front, back and two side panels, with a central stiffening rib integrally formed with and extending between the front and back panels. The body is molded with the lid in the open position connected to the body by integrally molded hinges. The body is also molded with an access opening in the top and the upper portion of the front panel through which the cigarettes packed in the container are removed.

The lid is formed with several panels which are integrally and hingedly molded to the top of the container body and is reclosable after opening to help maintain the freshness of the cigarettes contents of the container. Inner surfaces of the lid side panels are molded with longitudinal grooves or depressions which are adapted to engage in a "snap-fit" manner with corresponding longitudinal ridges or protrusions on the confronting side panels of the container body to maintain the lid in a secure closed position. Alternatively, the grooves and ridges may be molded on the body and lid, respectively. When the lid is closed, it is flush on all sides with the body of the container to provide a smooth surface onto which a label containing trademarks, logos, advertisements, product information or other printed or embossed indicia may be placed or adhered. The label substrate may be may be paper, metal foil, a single- or multi-layer polymeric film or the like. The paper or polymeric film may be metallized with an aluminum metal, for example. A preferred label is an adhesive-backed metallized paper.

As previously mentioned, the bottom of the as-molded container is open and includes a recessed shoulder or ledge around its internal perimeter on which the base of the container bears when it is inserted into the open bottom of the container body after the cigarettes are loaded in the body through the open bottom. A heat-activated adhesive is applied to the surface of the metal (aluminum) foil of the flat laminate sheet or the injection molded base so as to cover the entire inwardly facing foil surface of the base. A separate paper or paperboard sheet having the same shape, but a slightly smaller area than the metal foil and base is positioned between the heat-activated adhesive surface of the base and the ends of the cigarettes to provide a protective liner or barrier between the ends of the cigarettes in the container and the heat-activated adhesive of the base and thereby prevent the cigarettes from sticking to the adhesive when it is activated by heat. Because the paperboard liner has a smaller area than the base, it does not bear on the shoulder or ledge at the bottom of the body, but is dimensioned so that it will fit inside the bottom of the container body below the shoulder or ledge.

A sheet material, preferably a metal foil, is adhesively bonded over the access opening in the top and front panel of the body and the lid is then closed. With the container lid closed and the bottom open and oriented upwardly, a batch of twenty cigarettes is loaded into the container body through the upwardly open bottom of the container body. The paperboard protective liner is then inserted into the open bottom of the body past the shoulder and is supported on the cigarette ends and the central molded rib of the body. The base is then inserted into the open bottom of the container body with the heat-activated adhesive surface around the edge of the base bearing on and in contact with the shoulder or ledge of the plastic body. The bottom end of the container is then induction heated for a period of time to activate the adhesive in contact with the shoulder and form an adhesive bond between the shoulder of the plastic body and the base. Should the heat-activated adhesive be activated in an area greater than the portion that is in contact with the shoulder, the paper or paperboard protective liner prevents the adhesive from adhering to the tobacco or the cigarette paper at the ends of the cigarettes in the container. The heat-activated adhesive may also be applied to the thin perimetrical edge of the base that confronts the sidewall of the open end of the container body. Upon activation of the adhesive, the edge of the base will also bond to the sidewall of the body.

The induction heating device for heat-sealing the base to the container body comprises a sealer head made of a non- or low-heat conducting material in which is formed a cavity corresponding in size and geometrical shape to the container. A coil is wound inside the sealer head about the cavity and is energized by electrical energy to generate heat in the cavity. When a container is positioned in the cavity, the coil is energized to a level that causes the heat-activated adhesive only on the edges of the base in contact with the shoulder to be activated.

Although the bonding technique described above is preferred and is one important aspect of the present invention, other techniques may be employed to bond the base in the open end of the container body without departing from the intended scope of the invention. For example, instead of bonding the base to the body with a heat-activated adhesive, the contacting portions of the plastic of the base and body may be bonded by other types of adhesives, by ultrasonic or laser welding or other techniques that will be apparent to those of skill in the art.

With the foregoing and other advantages and features of the invention that will become hereinafter apparent, the nature of the invention may be more clearly understood by reference to the following detailed description of the invention, the appended claims and the views illustrated in the drawings.

BRIEF DESCRIPTION OF THE DRAWINGS

FIG. 11 is a top perspective view with a cut-away of the container of FIG. 7 without the base.

FIG. 12 is a bottom perspective exploded view of the container of FIG. 7 with the base separated from the body of the container.

DETAILED DESCRIPTION OF THE INVENTION

Figure 1:
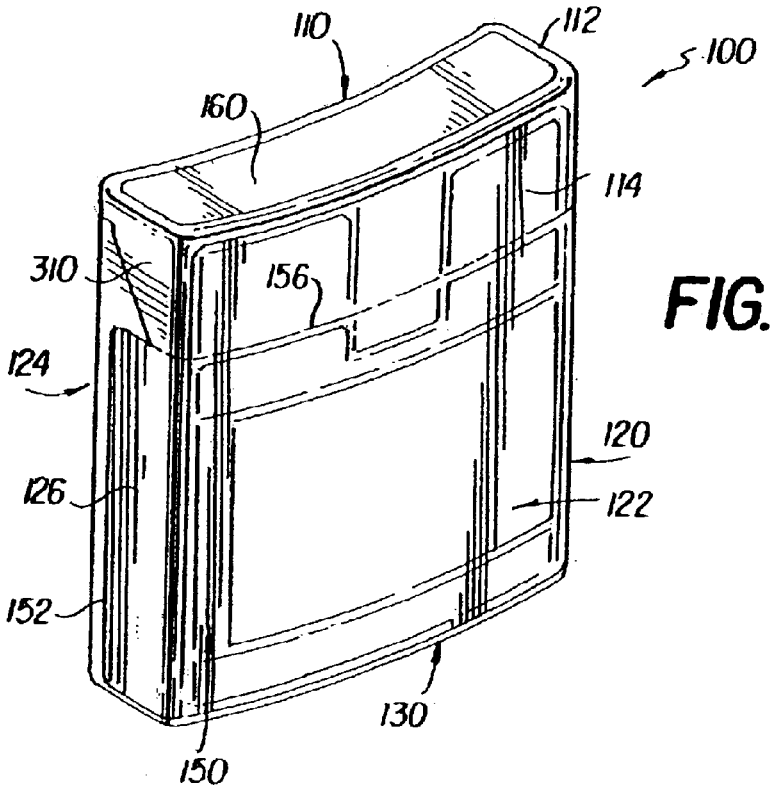
FIG. 1 is a front perspective view of a cigarette container made according to the invention shown in a closed position.
Figure 2:
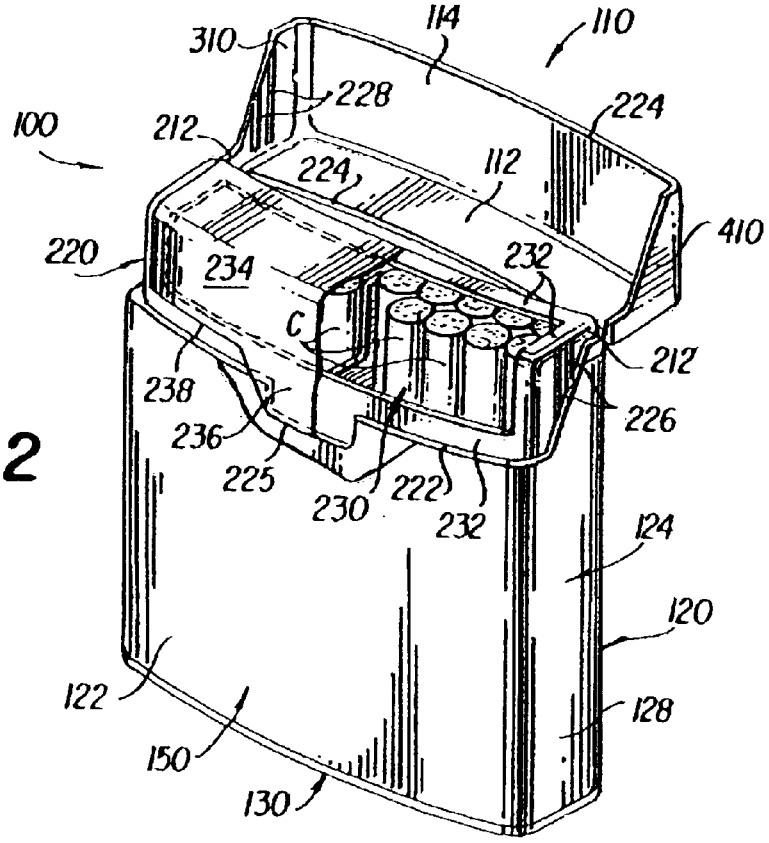
FIG. 2 is a front perspective view, partly broken, of the cigarette container of FIG. 1 in an open position.

Referring now to the drawings in detail, FIGS. 1 and 2 are front perspective views of the container 100 of the present invention in the closed and open positions. Although the container may be used to hold or package a variety of items, the preferred embodiment of the invention is a container for packaging cigarettes. The orientation of the cigarettes C in the container is such that the filters of the filter cigarettes are oriented toward the top panel of the container, and the bottom panel of the container is the side of the container opposite the top panel. The front and back of the container are the two sides of the container having the greatest surface area, and the remaining two opposite sides or end panels extend between and connect the front and back and the top and bottom.

The container 100 is a generally rectangular flask-shaped box or parallelepiped having a slightly convexly curved front panel 122 and a slightly concavely curved back panel 124. The curved front 122 and back 124 body panels increase the container's strength and rigidity because they better resist bending and flexing as compared to a container having flat or planar body panels.

The container has a narrow profile that is designed to hold twenty cigarettes, preferably in a 10-10 configuration, that is, two rows of ten, although other packing configurations and numbers of cigarettes are contemplated within the scope of the invention. The curved shape and narrow profile conform to the natural curves of a person's hand and body so that the container is easy to grasp and easily fits into a shirt, coat or pant pocket. In addition, the flask-shape of the container helps to distinguish it from other cigarette containers currently available, utilizing the unique design of the container to enhance product identification with the consumer.

The container comprises three main components, the lid 110, the body 120, and the base 130. All three parts of the container are preferably made of a plastic material having a low permeability that protects the contents of the container from being crushed and preserves the freshness and aroma of the cigarettes. The lid 110 and body 120 are preferably molded together in one piece with the lid in the open position and connected to the body by integral hinges. The flat base 130 is preferably die-cut from a flat sheet of a plastic/aluminum foil laminate or injection molded of a plastic material with an aluminum metal foil substrate bonded to one surface thereof. Although the most preferred material for the container is a moldable and die-cuttable polymeric material, such as an injection-moldable polypropylene, it is contemplated that the container body and base could be made of other materials, including paperboard, wood, tin, aluminum or other metals without departing from the scope of the invention.

Figure 3:
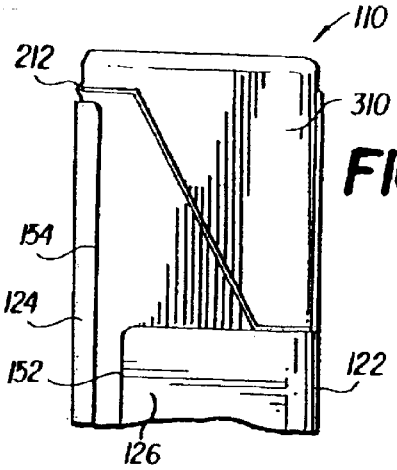
FIG. 3 is a fragmentary left side view of the lid in the closed position.
Figure 4:
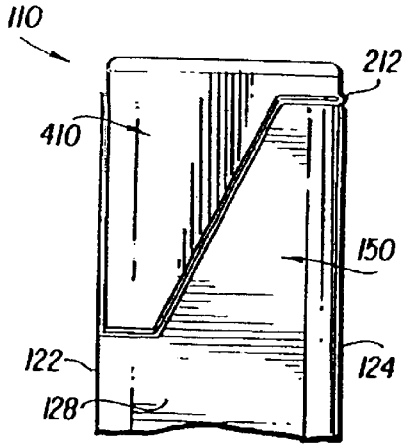
FIG. 4 is a fragmentary right side view of the lid in the closed position.
Figure 5:
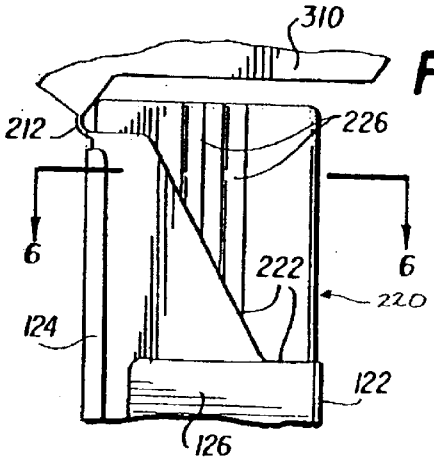
FIG. 5 is a fragmentary left side view of the container with the lid in the open position.

Each part of the container will now be described in greater detail with particular reference to FIGS. 1–4. The body 120 is a four-sided box comprising rectangularly-shaped front and back fin, panels 122, 124, respectively, and side panels 126, 128. The lid 110 has a flat top 112, a slightly curved, rectangularly-shaped front panel 114 and a pair of triangularly-shaped side panels 310 and 410. The curvature of the front panel 114 matches the curvature of the front body panel 122 to present a smooth surface. The lid 110 is pivotably or hingedly attached to the top of the body 120 by a pair of so-called "living" hinges 212 integrally molded between and connecting the lid 110 and the body 120 at the upper and outermost portions of the back panel of the body. The hinges 212 are narrow flat straps, as best seen in FIGS. 2 and 5, which bend back-and-forth as the lid is pivoted between the open and closed positions. The base 130 is a separately formed multi-layer flat plate that is sealingly affixed in the open bottom end 131 (FIGS. 11 and 12) of the container body 120 after the cigarettes C have been inserted into the body 120.

Figure 6:
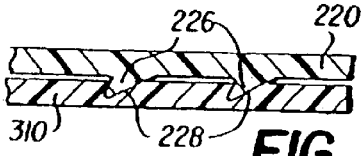
FIG. 6 is a cross-sectional view taken along line 6—6 of FIG. 5 showing the securing mechanism for the lid.

As best seen in FIG. 2, the upper portion of the body 120 is molded with a recessed portion 220 which forms an edge 222 along the front, sides and back of the body that mates with a corresponding edge 224 of the lid 110 and supports the lid when it is in the closed position. A cutout or depression 225 is provided in the edge 222 on the front panel 122 for a purpose to be described. At both sides (only one shown) of the recessed portion 220, there are molded a pair of longitudinal protrusions or ridges 226. The inside surfaces of the triangular lid sides 310 and 410 are provided with corresponding pairs of recesses or grooves 228 which lockingly engage with the ridges 226 to securely hold the lid in the closed position. FIG. 6 shows an enlarged cross-sectional view of the protrusions 226 on the left side of the recessed portion 220 engaging in the grooves 228 on the left inside surface of the lid side 310. This arrangement of protrusions and grooves may also be provided on the right side of the recessed portion and the inside surface of the lid side 410. Although the preferred embodiment of the invention shows protrusions and grooves for securing the lid in a closed position on both sides of the lid, protrusions and grooves need be provided on only one side of the lid or other lid securing means may be used without departing from the scope of the invention.

The recessed portion 220 is a molded extension of the body 120, and is recessed from the outermost surfaces of the panels 122, 124, 126, 128 so that it can fit inside the lid 110 while still allowing for smooth transitional surfaces, i.e., flushness, between the outermost surfaces of the lid 110 and the body 120 when the lid is closed. The recessed portion 220 of the body has an L-shaped access opening 230 in the top and front panel thereof so that the cigarettes C in the container can be accessed and removed by the consumer. The opening 230 is completely surrounded by a shoulder or ledge 232. A sheet material 234, such as a metal foil sheet or laminate 234, preferably an aluminum foil, is adhesively affixed to the shoulder 232 to close and seal the opening 230 over the cigarettes C and provide a substantially impermeable barrier over the opening to help maintain the freshness and aroma of the cigarettes C. The foil sheet 234 has a tab 236 which may extend into the cutout 225, but which is preferably creased at the bottom edge 238 of the sheet 234 and folded upwardly over the front surface of the sheet 234 before the lid is closed for loading of the cigarettes into the container. Instead of the foil sheet 234, the opening 230 may be closed by a thin, integrally molded polymeric membrane (not shown) that is removed or fractured by the consumer to access the cigarettes C.

Figure 7:
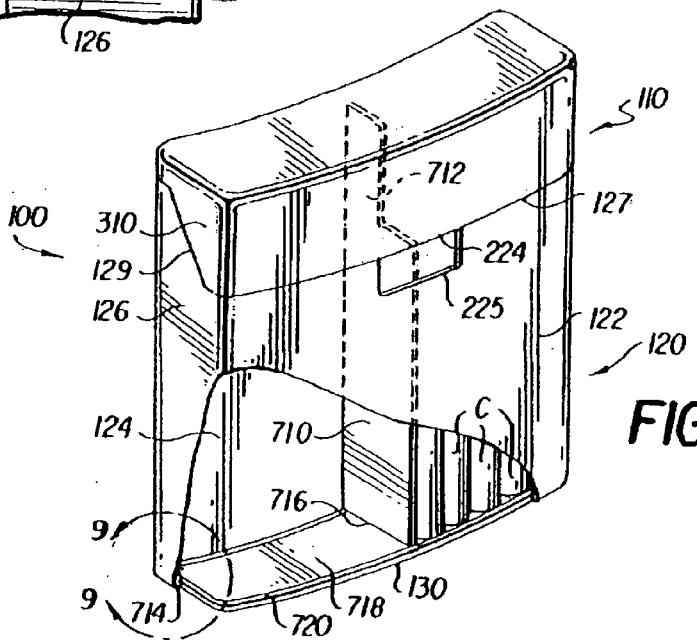
FIG. 7 is a front perspective view, partly broken, of the cigarette container of the invention showing the interior of the container.

The cutout 225 facilitates opening of the lid 110 by the consumer by exposing a central portion of the edge 224 of lid front panel 114 when the lid 110 is in the closed position (FIG. 7). The consumer may, for example, use a finger or fingernail to engage the exposed edge 224 and lift the lid upwardly from the closed position shown in FIG. 1 to the open position shown in FIG. 2.

Referring to FIG. 7 the container 100 is provided with a central rib 710 which reinforces the front and back body panels 122 and 124 and further prevents the container body 120 from being crushed with consequent damage to the cigarettes C contained therein. The rib 710 also advantageously provides support for maintaining the dimensions of the cavity in the container body during loading of the cigarettes into the body, as well as support for the body during vacuum packing of the container. The support rib 710 divides the interior of the container into two equally sized chambers, with each chamber holding two rows of five cigarettes (5-5) in the embodiment shown. The top portion 712 of the rib has an L-shape so that the two chambers of the container are in communication with one another and their contents are easier to access. The inside surface of the body 120 is provided with a perimetrical shoulder 714 adjacent the open bottom 131 (as shown in FIGS. 11 and 12) of the body. The base 130 fits inside the bottom end of the body 120 and its perimetrical edge engages the shoulder 714 and is separated from the bottom 716 of the rib 710 by a paper or paperboard insert or liner 718 with a perimetrical edge 720. The sheet 718 forms a protective liner between the cigarettes C in the package and the base 130 as described in more detail hereinafter.

Figure 8:
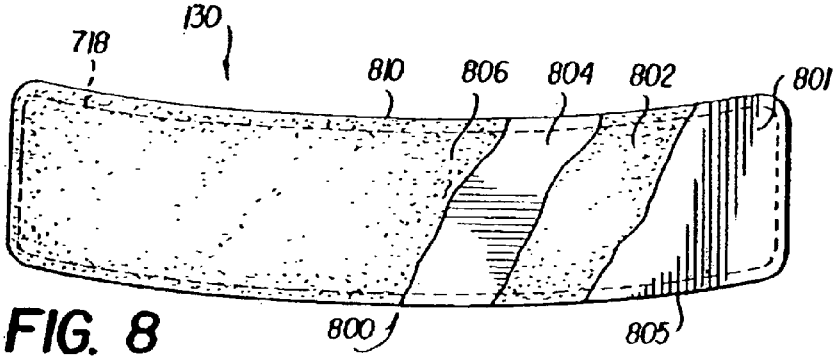
FIG. 8 is a top plan view, partially broken, showing the layers of the base of the cigarette container.

FIG. 8 illustrates the construction of the base 130 which comprises a flat plate 800 approximately 1 millimeter thick with a perimeter that corresponds to the inside perimeter of the body 120 below the shoulder 714. The plate 800 is preferably die-cut from a laminate comprising a polypropylene sheet 801 laminated to a metal foil substrate 804 with an adhesive or bonding agent 802. The plate 800 may also be injection molded with the metal foil substrate 804 subsequently bonded thereto. A heat-activated adhesive 806 is applied to the entire upper surface of the metal foil 804 and may also be applied to the edge 805 of the plate 800. The size and shape of the paper or paperboard liner 718 relative to the plate 800 is shown by the dashed lines in FIG. 8. The difference in size of the liner 718 and plate 800 leaves a narrow perimetrical strip or border 810 of the heat-activated adhesive 806 that engages the shoulder 714. The metal foil 804 is preferably an aluminum foil with a thickness in the range of about 0.0015 inch to about 0.005 inch, preferably about 0.003 inch.

Figure 9:
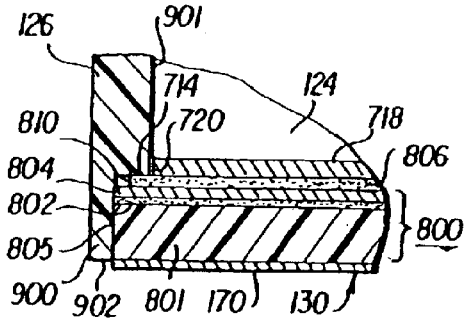
FIG. 9 is a cross-sectional detail view of the cigarette container of detail 9—9 of FIG. 7 showing the connection between the body and the base.

The base 130 is attached to the bottom of the container body 120 as shown in FIG. 9. FIGS. 11 and 12 show the bottom of the container body 120 with the base 130 removed to illustrate the open bottom 131. With the open bottom 131 of the container body oriented upwardly, the cigarettes C are loaded or inserted into the two chambers of the body. The paperboard protective liner 718 is then inserted into the open bottom 131 and is supported on the ends of the cigarettes and the bottom 716 of the rib (FIG. 7). Because of its smaller size, the liner 718 passes through the bottom rim 900 of the body 120 and the edge 720 thereof abuts the inside wall 901 of the body adjacent the shoulder 714. The plate 800 is then urged into the bottom rim 900 of the body so that the surface of the heat-activated adhesive 806 bears in close contact with the shoulder 714. The outermost surface of the plate 800 is flush with the end surface 902 of the body to permit tax stamping of the container on the bottom thereof.

After the plate 800 is inserted, the container 100 is then placed in an appropriately shaped cavity of the sealer head of an induction heating device (not shown). The induction heating device is energized and the container is induction heated at the bottom end thereof to activate the adhesive 806 only at the edge region 810 (FIG. 8) and bond the base plate 800 to the shoulder 714 of the body. If heat-activated adhesive has been applied to the perimetrical edge 805 of the plate 800, the edge 805 will also bond to the inside wall of the rim 900. In the event the induction heating process activates the adhesive 806 inwardly beyond the edge region 810, the protective liner 718 prevents the adhesive 806 from coming into contact with and sticking to the ends of the cigarettes C in the container.

The aluminum foil 804 advantageously functions as a heat sink for absorbing the heat of induction and rapidly melting the heat-activated adhesive 806 in the edge region 810. The induction heating process is preferably conducted in a vacuum chamber at a pressure in a range of about 10 to 20 inches of water. After the container is removed from the sealer head and cooled, the base is securely bonded to the base thereby producing a vacuum-sealed cigarette package. Vacuum-filling processes other than a vacuum chamber may also be used as will be apparent to those skilled in the art.

A preferred heat-activated adhesive for use in the preferred embodiment of the invention is an adhesive sold by Protect-all, Inc. of Darien, Wis. under the designation P-1004, however, as those skilled in the art will appreciate, other suitable heat-activated adhesives may be used.

It is contemplated according to the invention that the cigarettes may be packaged in the container without vacuum sealing, however, vacuum sealing advantageously helps to maintain the freshness and shelf life of the cigarettes as well as the perception of freshness. When sealed with a sufficient vacuum, the initial opening of the container of the invention will produce an audible sound of air rushing into the container indicating to the consumer the vacuum packaging of the container and the freshness associated with vacuum packaging.

The plastic material from which the container base is die-cut or injection molded is preferably polypropylene. The container body and lid are also preferably an injection moldable polypropylene. Polypropylene is relatively gas impermeable as compared with other reasonably cost-effective moldable polymeric materials, however, other polymeric materials, such as, for example, high density polyethylene, may be used. To improve the impermeability of the plastic container, the molded polypropylene container body, lid and base may be treated with a low permeability coating, such as an epoxy amid. Alternatively, the polymeric resin from which the container is made may be a crystallized plastic molding which is a stronger plastic and a better gas barrier then a non-crystallized plastic. Typically, for example, when polyethylene terephthalate (PET) is injection molded, it is left in the amorphous state because it is transparent in that state. However, if the PET is crystallized, it is an opaque white material and its strength and effectiveness as a gas barrier is substantially increased. To crystallize the plastic, the PET is heated to approximately 120 degrees Celsius for about 30 seconds in its desired shape. Alternatively, rather than using PET or other polymeric resin that requires a crystallization step, a more expensive, but inherently highly crystalline resin, such as polyethylene vinyl alcohol (PVA), can be used as the gas impermeable injection molded plastic for the container.

Another way to improve the impermeability of the plastic container 100 is to cover all or most of the external surfaces of the container with a metal foil, such as an aluminum foil.

Figure 10:
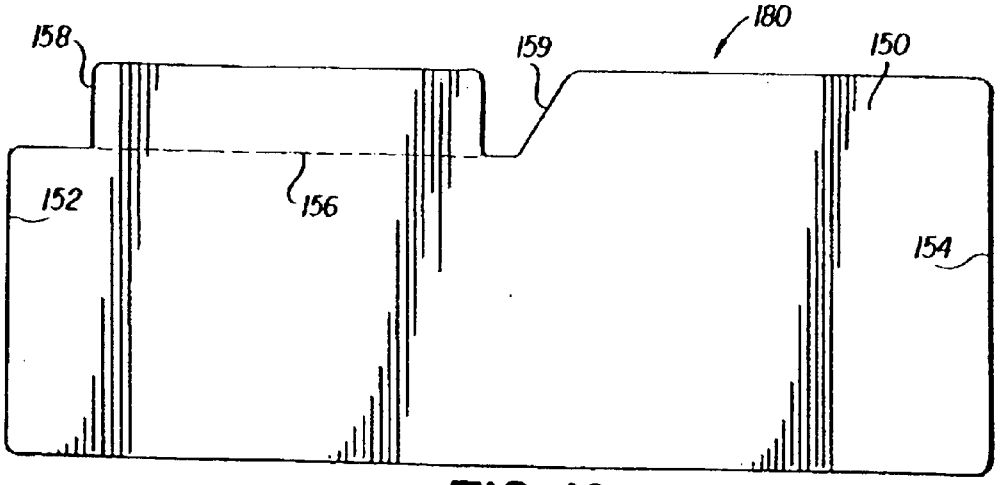
FIG. 10 is a front elevation view of a blank for a label for the cigarette container.

FIG. 10 illustrates a sheet or blank 180 which forms the printed and/or embossed label 150 that is adhered to the front, sides and back of the container 100. The label 150 is preferably an adhesive-backed metallized paper but may be made of other materials, such as a metal foil, a metallized polymeric film or the like. The edge 152 of the label 150 is placed on the container starting at the rear corner edge of the left side 126 of the container body (FIG. 1) and is adhered to the side 126 of the body, the front panels 122, 114 of the body and lid, the side 128 of the body and the back panel 124 of the body until the edge 154 meets, overlaps or is slightly spaced from the edge 152 (FIG. 3). Cut-outs 158 and 159 are provided on the label 150 so that the lid sides 310, 410 are not covered by the label (FIGS. 3–4). A perforation line 156 extends between the cut-outs 158 and 159 for a purpose to be described. Adhesive-backed metallized paper strips 160 (FIG. 1), 170 (FIG. 9) may also be applied to the top panel 112 of the lid and the outer surface of the base 130. Preferably, the metallized label 150 and the metallized strips 160, 170 are provided with printed and/or embossed product information, trademarks, logos, and the like. Tax stamping may be applied to the strip 170.

The label 150 covers the cutout 225 on the front of the body and the joints 127, 129 between the lid 110 and the body 120. To open the container, the consumer uses a fingernail, coin or other object to break the label 150 along the perforation line 156, then engages the now-exposed lower edge 224 of the lid 110 and raises the lid to the open position shown in FIG. 2. The consumer then grasps the tab 236 of foil 234 and pulls it outwardly and upwardly to detach the foil 234 from the front and sides of the ledge 232 and expose the cigarettes C for access. It will be appreciated that the foil 234 may be left adhered to the rear portion of the ledge 232 so that it may be repositioned over the opening after a cigarette C has been removed from the container. In this way, the cigarette container may be opened and the contents removed by the consumer without the need to discard any portion of the container.

The above-described cigarette container 100 provides a combination of advantages for a cigarette package, some, but not all of which may exist in prior art cigarette packages. In particular, the cigarette container 100 has an improved ergonomic curved and slimmer shape with rounded edges for handling comfort, ease and comfort of carrying in a pocket and product differentiation; a reclosable and resealable lid; a vacuum-sealed package with an audible "freshness" sound when the container is opened; readily recyclable materials; improved structural strength to prevent crushing; an easily printed or embossed metallized label which also functions as a gas barrier; and reduced consumer waste upon opening.

It is contemplated, although not necessary according to the invention, to overwrap the container 100 with a further conventional overwrap film having a tear tape (not shown). Such overwrap may be made of a foil/paper laminate, a metallized paper or plastic, or a low permeability transparent or metallized polymeric sheet may be applied to the container to further maintain the freshness of the cigarettes.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A package for articles, such as cigarettes, comprising:

a generally parallelepiped-shaped container having a curved profile and an internal space for containing the articles, the container comprising a container lid, a container body, and a container base, the lid and body being integrally molded from a polymeric material with the lid in an open position and being connected together by hinges molded integrally with the lid and body, the body being molded with a top panel, a curved front panel, a curved back panel, two side panels, and an open bottom, the base comprising a layer of polymeric sheet material and being affixed in the open bottom of the body after the articles have been inserted into the internal space, the lid of the container being hingedly movable from the open position to a closed position in which the lid covers the top panel and a portion of the front panel; and a central rib in the internal space of the container body extending between the front and back panels of the body and dividing the internal space of the container into two chambers, each chamber being dimensioned to contain ten cigarettes in two rows of five cigarettes each, the rib having an L-shaped upper portion for facilitating access to the cigarettes.

2. The package of claim 1, including an access opening in the top panel and the portion of the front panel covered by the lid in its closed position, a ledge formed on the top panel and the front panel surrounding the access opening and a foil sheet removably adhered to the ledge and covering the access opening.

3. The package of claim 1, wherein the container body is formed with an internal perimetrical shoulder adjacent the open bottom of the body, the base having a perimetrical shape corresponding to an internal perimetrical shape of the body at the internal shoulder, the base being adhesively affixed to the internal shoulder.

4. The package of claim 3, including a metal foil layer bonded to the polymeric sheet material of the base and a heat-activated adhesive layer applied to the surface of the metal foil layer, the heat-activated adhesive layer contacting the internal perimetrical shoulder of the body and being activated by heat so as to adhesively affix the base to the internal perimetrical shoulder of the body and form a bottom panel of the body.

5. The package of claim 4, including a protective liner disposed between the cigarettes in the container and the heat-activated adhesive layer to prevent the adhesive layer from sticking to the cigarettes when it is activated by heat, the protective liner having a perimetrical shape corresponding to the internal perimetrical shape of the body and having an area smaller than the base.

6. The package of claim 5, wherein the protective liner is made of a paper or paperboard sheet material.

7. The package of claim 1, wherein the body is molded with a recessed portion in the top panel, the front panel and the two side panels, the recessed portion receiving the lid in the closed position so that outermost lid surfaces are substantially flush with outermost body surfaces.

8. The package of claim 1, wherein the polymeric material of the body, lid and base is polypropylene and the base comprises a flat laminate of a layer of polypropylene laminated to an aluminum foil with a heat-activated adhesive applied to the surface of the aluminum.

9. The package of claim 1, including a joint between the lid and body on the front panel, a label wrapped about the body and lid when the lid is in the closed position and covering the joint between the lid and body, the label having perforations therein along the joint between the lid and body.

10. The package of claim 1, including a joint between a front edge of the lid and the front panel of the body, a label wrapped about the body and lid when the lid is in the closed position and covering the joint, the label having perforations therein along the joint to facilitate tearing of the label along the joint when the lid is opened.

11. The package of claim 10, including a depression formed in the body adjacent the joint, the front edge of the lid being accessible from the depression to open the lid.

12. The package of claim 10, wherein the label is an adhesive-backed metallized paper, and wherein the package further includes adhesive-backed metallized paper label strips applied to the lid and the base of the container.

13. The package of claim 1, wherein the polymeric material of the lid and body is a crystallized polymeric material from the group consisting of polypropylene, polyethylene terephthalate and polyethylene vinyl alcohol.

14. The package of claim 1, wherein the base is affixed to the container body by heat sealing in a vacuum with the internal space of the container at a pressure slightly less than atmospheric pressure.

15. The package of claim 1, including an access opening in the top panel and the portion of the front panel covered by the lid in its closed position, a ledge formed on the top panel and the front panel surrounding the access opening and a foil sheet removably adhered to the ledge and covering the access opening, a joint between a front edge of the lid and the front panel of the body, a depression formed in the front panel of the body adjacent the front edge of the lid, the foil sheet having a tab extending into the depression for removing the foil sheet from the access opening.

16. The package of claim 1, wherein the base is flush with the end of the container body so that a cigarette tax stamp can be applied to an outside surface of the base.

17. The package of claim 1, wherein the front panel is convexly curved and the back panel is concavely curved.

18. The package of claim 1, wherein the body, lid and hinges are integrally molded together in one piece, the hinges comprising two integrally molded hinges connected between the body and the lid at an uppermost and outermost portion of the curved back panel of the body.

19. The package of claim 1, wherein the lid and body include locking elements that lockingly engage when the lid is in the closed position to hold the lid in the closed position.

20. The package of claim 19, wherein the locking elements comprise protrusions located on one of the body and lid and grooves located on the other of the body and lid.

21. The package of claim 19, wherein the locking elements are located on at least one side panel of the body.

22. The package of claim 1, wherein the body and lid are treated with a low permeability coating.

23. The package of claim 22, wherein the low permeability coating is an epoxy amid.

24. The package of claim 1, wherein the top panel of the body comprises a removable polymeric membrane for accessing the cigarettes in the container.

25. A package for cigarettes comprising a generally rectangularly-shaped parallelepiped container having an internal space for containing the cigarettes, the container comprising a lid, a body and a base, each of which is made of a plastic material;

the body having a top end with a recessed portion an access opening, a ledge surrounding the access opening wherein a foil sheet is adhesively adhered to the ledge and covering the access opening, a convexly curved front panel, a concavely curved back panel, two side panels and an open bottom end having an internal perimetrical shoulder and a corresponding internal perimetrical shape;

the lid of the container being movable between an open position exposing the recessed portion and access opening of the body and a closed position covering the recessed portion and access opening of the body,;

the base being sealed in the open bottom end of the body, the base comprising a plastic/metal foil laminate having a perimetrical shape corresponding to the internal perimetrical shape of the bottom end of the body and being supported by the internal perimetrical shoulder, wherein a heat-activated adhesive layer is applied to the metal foil of the base for bonding the base to the shoulder when the adhesive is activated by heat, and a central rib in the internal space of the container extending between the front and back panels of the body for stiffening the container and dividing the internal space of the container into two chambers, each chamber being dimensioned to contain ten cigarettes in two rows of five cigarettes each, the rib having an L-shaped upper end for facilitating access to the cigarettes.

26. The package of claim 25, wherein the base is bonded to the container in a vacuum with the internal space of the container at a pressure slightly less than atmospheric pressure.

27. The package of claim 25, including a protective liner disposed between the cigarettes in the container and the heat-activated adhesive layer to prevent the adhesive layer from sticking to the cigarettes when it is activated by heat, the protective liner having a perimetrical shape corresponding to the internal perimetrical shape of the body and having an area smaller than the base.

28. The package of claim 25, including a joint between a front edge of the lid and the front panel of the body, a label wrapped about the body and lid when the lid is in the closed position and covering the joint, the label having perforations therein along the joint to facilitate tearing of the label along the joint when the lid is opened.

29. The package of claim 25, Including a depression formed in the body adjacent the joint, the front edge of the lid being accessible from the depression to open the lid.

30. The package of claim 25, wherein the label is an adhesive-backed metallized paper, and wherein the package further includes adhesive-backed metallized paper label strips applied to the lid and the base of the container.

31. The package of claim 25, wherein the plastic material of the lid and body is a crystallized polymeric material from the group consisting of polypropylene, polyethylene terephthalate and polyethylene vinyl alcohol.

32. The package of claim 25, including a pair of hinges connecting the lid and body at the curved back panel of the body, the lid, body and hinges being integrally molded together in one piece with the lid in the open position.

33. The package of claim 18, wherein the body and lid are treated with a low permeability epoxy coating.

34. A method of packaging a container for cigarettes wherein the container comprises a lid, a body, and a base, the body having an internal space and an access opening with a ledge around the opening, a front panel, a back panel, two side panels and an open bottom end with an internal perimetrical shoulder adjacent the open bottom end of the body, the lid of the container being molded integrally with the body and movable between an open position exposing the access opening of the body and a closed position covering the access opening of the body, the base having a heat-activated adhesive layer applied to a surface thereof, comprising the steps of sealing the access opening of the body by adhering a foil sheet to the ledge around the access opening when the lid is in the open position; inserting a plurality of cigarettes into the internal space of the body through the open bottom end of the body; inserting the base into the open bottom end of the body with the heat-activated adhesive layer in contact with the internal perimetrical shoulder; and heating the adhesive to seal the base to the bottom end of the body.

35. The method of claim 34, including the step of closing the lid after the foil sheet is adhered to the ledge.

36. The method of claim 34, including the step of applying a label to the body and lid when the lid is in the closed position.

37. The method of claim 34, including the step of placing a protective liner in the open bottom, of the body onto the cigarettes after the cigarettes have been inserted into the internal space of the body and before inserting the base into the open bottom end of the body.

38. The method of claim 34, including the step of placing the container in a vacuum chamber before sealing the base to the bottom end of the body and reducing the pressure in the chamber to less than atmospheric to create a vacuum in the internal space of the body.

39. The method of claim 34, wherein the heating step comprises induction heating.

40. The method of claim 39, wherein the step of induction heating comprises the steps of inserting the container in a cavity of an induction heating device and applying the induction heating only at the bottom end of the body.

41. The package of claim 1, wherein the polymeric material is high density polyethylene.

42. A package for cigarettes comprising:

a generally parallelepiped-shaped container having a curved profile and an internal space for containing the cigarettes, the container comprising a container lid, a container body, and a container base, the lid and body being integrally molded from a polymeric material with the lid in an open position and being connected together by hinges molded integrally with the lid and body;

the body comprising a top panel, a curved front panel, a curved back panel, two side panels, an open bottom, and a central rib in the internal space of the container body extending between the front and back panels of the body and dividing the internal space of the container into two chambers, each chamber being dimensioned to contain ten cigarettes in two rows of five cigarettes each, the rib having an L-shaped upper portion for facilitating access to the cigarettes;

the lid of the container being hingedly movable from the open position to a closed position in which the lid covers the top panel and a portion of the front panel of the body; and the base being affixed in the open bottom of the body.

43. The package of claim 42, wherein the base is die-cut from a flat sheet of a plastic/aluminum foil laminate.

44. The package of claim 42 wherein the base is injection molded of a plastic material with an aluminum metal foil substrate bonded to one surface thereof.

45. The package of claim 1, wherein the base is affixed in the open bottom of the body to form a hermetic seal sufficient to maintain a vacuum in the container body.

46. The package of claim 25, wherein the base and the foil sheet form a hermetic seal with the body sufficient to maintain a vacuum in the container body.

47. The method of claim 34, further comprising forming hermetic seals with the base and the foil sheet sufficient to maintain a vacuum in the container body.

48. The package of claim 42, wherein the base is affixed in the open bottom of the body to form a hermetic seal sufficient to maintain a vacuum in the container body.

* * * * *